US012474150B2

(12) United States Patent
Archibald et al.

(10) Patent No.: US 12,474,150 B2
(45) Date of Patent: Nov. 18, 2025

(54) MAGNETIC-KEY SAFETY INTERLOCK SYSTEM

(71) Applicant: Probe Technology Services, Inc., Fort Worth, TX (US)

(72) Inventors: Roger Archibald, Hurst, TX (US); Bulent Finci, Aledo, TX (US); Jacob Walsh, Benbrook, TX (US); Stephen Cattanach, Hempstead, TX (US)

(73) Assignee: Probe Technology Services, Inc., Fort Worth, TX (US)

( * ) Notice: Subject to any disclaimer, the term of this patent is extended or adjusted under 35 U.S.C. 154(b) by 253 days.

(21) Appl. No.: 18/524,842

(22) Filed: Nov. 30, 2023

(65) Prior Publication Data

US 2025/0180341 A1 Jun. 5, 2025

(51) Int. Cl.
*F42D 5/00* (2006.01)
*F42D 1/05* (2006.01)
*E21B 43/1185* (2006.01)

(52) U.S. Cl.
CPC ..... *F42D 5/00* (2013.01); *F42D 1/05* (2013.01); *E21B 43/1185* (2013.01)

(58) Field of Classification Search
CPC ..... F42D 1/05; F42D 5/00; E21B 43/1185
See application file for complete search history.

(56) References Cited

U.S. PATENT DOCUMENTS 4,349,814 A 9/1982 Akehurst
4,812,674 A 3/1989 Sue et al.
5,113,467 A 5/1992 Peterson et al.
5,233,323 A 8/1993 Burkett et al.
5,239,202 A 8/1993 Hostetler
5,534,849 A 7/1996 McDonald et al.
5,541,562 A 7/1996 Fletcher et al.
5,551,267 A 9/1996 Janssen et al.
5,865,049 A 2/1999 Friedrich et al.
8,087,275 B2 1/2012 Poppe et al.
8,314,671 B2 11/2012 Fullerton et al.
8,692,637 B2 4/2014 Richards et al.
2008/0168811 A1 7/2008 Nagelski
2008/0224803 A1 9/2008 Nakayama et al.
2019/0390536 A1* 12/2019 Archibald ..... E21B 43/11857
2022/0042399 A1* 2/2022 Archibald ..... E21B 43/1185
2022/0062586 A1 3/2022 Urry

OTHER PUBLICATIONS

WIPO, International Search Report PCT/US2024/029108 (Aug. 8, 2024).

* cited by examiner

*Primary Examiner* — Mohamad A Musleh
(74) *Attorney, Agent, or Firm* — Vorys, Sater, Seymour and Pease LLP

(57) ABSTRACT

An interlock system for explosive operations includes an array of magnet sensors configured to engage an array of magnets in a magnetic key. The key may be selectively positioned to activate select sensors while the other remains deactivated. Various sequences of activated and deactivated sensors correspond to various states of the interlock system. One or more switches of the interlock system are set according the state of the system. Some states set the switches to disable any electrical signals from passing to the explosives. Other states set the switches to enable select signals to pass to the explosive or other tools. Explosive operations are enabled only in a particular predetermined state.

19 Claims, 15 Drawing Sheets

114
116
116
118
110a
110
110b
112
114
interlock
transceiver
110a
power supply
computer
110d
116
uphole
116
150
152
154
158
100a
downhole
102a
106a
104a
108a
104a
104a
104a
104a
100b
102b
106b
104b
108b
104b
104b
104b
120
104b

MAGNETIC-KEY SAFETY INTERLOCK SYSTEM

BACKGROUND AND SUMMARY

This invention pertains generally to technology for safety measures in the deployment of explosives in oil and gas wells. More specifically, the technology relates to a safety circuit controlled by the presence and position of a magnetic key.

Explosives are used in oil and gas wells for a variety of purposes. For example, perforating guns are used to perforate casing to access oil or gas reserves. Typically, the guns are deployed into the casing in a wellbore using an electrically conductive wireline. The guns include explosive charges which, when fired, proceed from the gun through the casing, thus perforating the casing. To ensure safe operation of the explosives, the firing circuit used to detonate the explosive from the surface is typically disabled by default and is selectively enabled through use of an interlock circuit.

A firing interlock circuit may have multiple settings to enable control of and communication with tools deployed in a well while still disabling the firing circuit(s) for explosive tools. For example, explosive tools may be stacked in a well with other tools (e.g., tractor, collar locator, gamma ray sensor) that must be controlled from the surface without triggering the explosive. Similarly, a stack may include more than one explosive tool that must first be inventoried and addressed without triggering the explosive so that the explosives may be selectively and separately triggered.

Inadvertent or improper firing of explosives can result in severe harm to personnel and equipment. For example, an explosive-containing tool string may be set up and tested on surface before being deployed in the well (to avoid tool failures in the well). Triggering an explosive during this process can have dire consequences. Similarly, the tool string in the well may be used for purposes other than the explosive effect and in any event must be properly positioned to achieve the desired explosive effect. Triggering an explosive during this process at the wrong position in the well can have dire consequences. An interlock circuit should disable triggering of the explosive until the operator is certain that triggering the explosive is proper.

A typical firing interlock circuit known in the art includes a mechanical key-operated switch that must be purposefully positioned by the operator to connect the firing circuit to the explosive. This approach is usually accomplished by mechanically coupling a keylock switch to a rotary switch with the circuit routing being physically wired through the switch. Such a configuration is prone the mechanical-coupling and mechanical-wiring failures. It is also susceptible to position failures in which the key is physically stopped between valid mechanical positions which could leave the wireline improperly routed, defeating the interlock protection.

The present invention improves on the state of the art by using a magnetically keyed interlock circuit. The key is a geometric array of magnets configured to engage a corresponding geometric array of magnet sensors (e.g., Hall-effect sensors) in a variety of positions, each position corresponding to a different interlock state. (As used herein, a "geometric array" of magnets or sensors refers to an ordered physical assembly of the magnets or sensors.) A controller receives the sensor signals, interprets the key state therefrom, and configures the interlock circuit by setting/resetting switches (e.g., relays) to connect the wireline to the circuit corresponding to the key setting. If the key setting is indeterminate, the key is missing, or the key is in a "safe" position, the controller terminates the wireline. This approach eliminates the keyed mechanical rotary switch, and its associated mechanical-coupling, mechanical-wiring, and indeterminate-key-position failures. The magnetic key may be configured to be magnetically held in position to engage the sensor array and may be configured to be larger and more visible than the typical key for the keylock rotary switch.

In an aspect of the invention, an interlock system includes a magnet-sensor array that includes at least three magnet sensors (e.g., Hall-effect sensors) that provide electrical outputs indicative of the presence or absence of the magnet adjacent to the sensor. The sensors are arranged in a geometric array. For example, the sensors may be arranged as a linear array (all the sensors are disposed on a line), an elliptical array (the sensors are disposed on the circumference of an ellipse, perhaps also with one or more sensors disposed within the circumference), or a polygonal array (the sensors are disposed on the perimeter of a polygon, perhaps also with one or more sensors disposed within the perimeter), or 3D variants thereof. Ultimately the sensor array corresponds at least in part to a geometric array of magnets forming a magnetic key (the sensor array an magnet array are keyed to each other). As used herein, a magnet array "corresponds" or is "keyed" to a sensor array when the magnet array and the sensor array can be positioned such that each of the magnets of the magnet array uniquely engage a sensor of the sensor array. Preferably, the magnet and sensor arrays are such that there are multiple relative positions of the arrays where each of the magnets of the magnet array engage a sensor of the sensor array. The state of the sensor array is the pattern of sensor outputs. For example, one state may be that no sensor detects a magnet. Another state may be that every other sensor detects a magnet. This sensor pattern (which may be expressed as a bit pattern) can indicate the presence and/or position of a magnetic key that corresponds to the sensor array.

The interlock system also includes electrically controllable switches and a controller. The controller is configured to detect the sensor-array state and provide switch-control signals according to the state. For example, the controller may receive digital signals from each of the sensors of the sensor array as a sequence of magnet/no-magnet signals (the pattern), compare this pattern to patterns predetermined to correspond to a particular key position, and generate the appropriate switch-control signals to place the switches in the states defined by the key position. For example, one key position (a first sensor pattern) may correspond to a "safe" mode of operation in which the controller sets the switches to disconnect an explosive from the firing circuitry. Another key position (a second sensor pattern) may correspond to a "fire" mode of operation in which the controller sets the switches to connect the explosive to the firing circuitry and thereby enable triggering of the explosive. The absence of a key could also correspond to a third sensor pattern corresponding to a predetermined switch state. As used herein, providing a switch-control signal includes ensuring the absence of any voltage or current. For example, the controller may set a switch into one position by providing a positive voltage to the switch control and may set the switch into a second position by placing the switch-control line at ground. Further, providing a switch-control signal includes providing a set of signals.

In another aspect of the invention, the interlock system may include paired mounting magnets to retain the magnetic key in position relative to the magnet-sensor array. One or more of these mounting magnets may be part of the magnet-array keyed to the magnet-sensor array.

BRIEF DESCRIPTION OF THE DRAWINGS

These and other features, aspects, and advantages of the present invention will become better understood with reference to the following description, appended claims, and accompanying drawings where:

DETAILED DESCRIPTION

Figure 1:
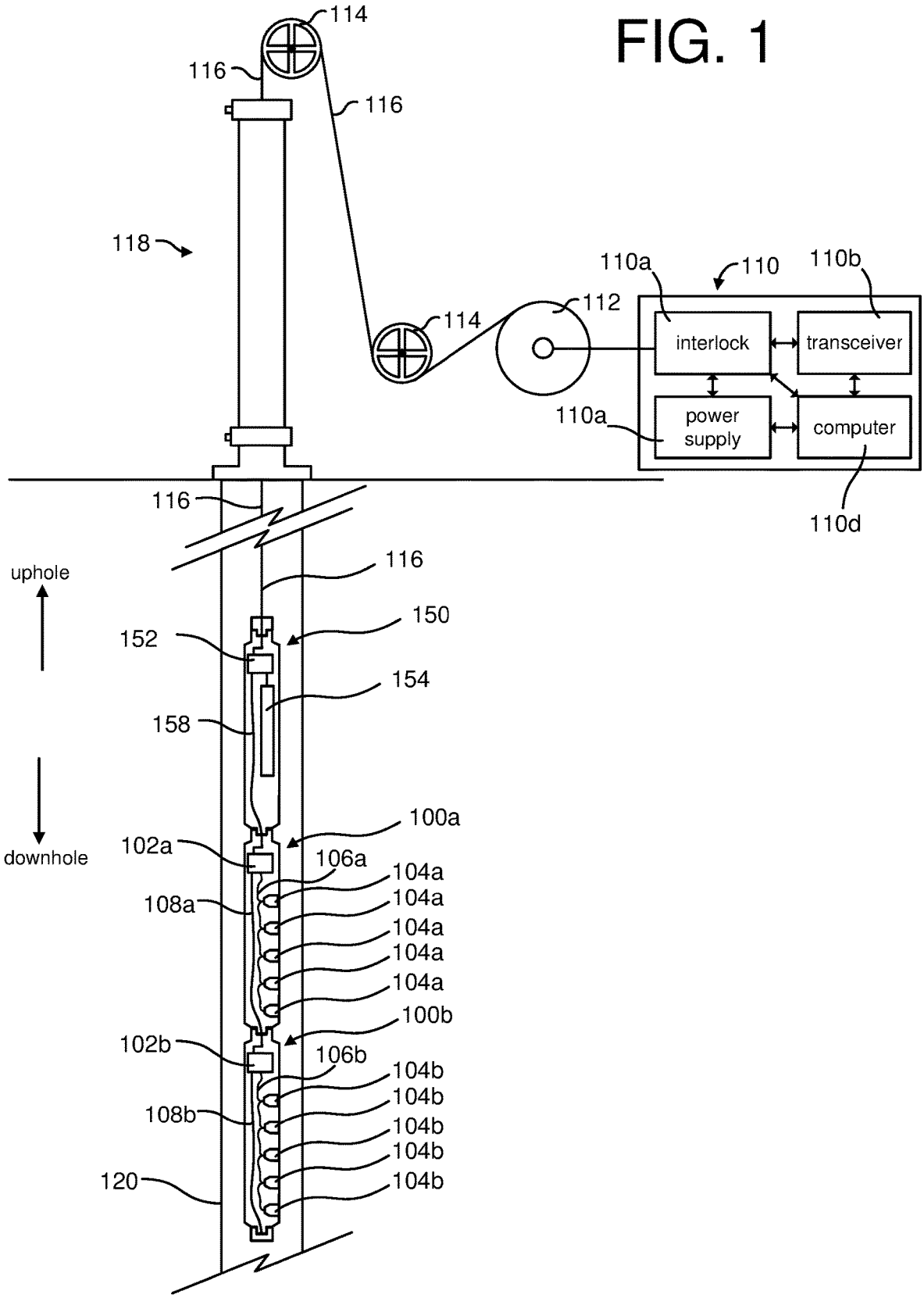
FIG. 1 is a functional block diagram illustrating perforating guns deployed in a cased wellbore via a wireline connected to a surface system.

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

FIG. 1 illustrates a stack of perforating guns 100*a*, 100*b* deployed in casing 120 in a wellbore as is known in the art. The stack of guns is connected to a surface system 110 via a wireline 116 that runs from a winch 112, through sheaves 114, through pressure control equipment 118, and into the wellbore. The stack may also include one or more non-explosive tools 150 such as a casing collar locator or gamma-ray detector. Such a tool typically has a communication circuit 152, a sensor 154, and a feedthrough line 158.

The guns 100*a*, 100*b* in the stack each include one or more explosive charges 104*a*, 104*b* connected to an initiator circuit 102*a*, 102*b* through a detonation cord 106*a*, 106*b* (or other explosive train). The guns 100*a*, 100*b* and other tools 150 are connected one-to-the-other through feedthrough lines 108*a*, 108*b*, 158. To trigger firing of the explosives, one or more of the initiator circuits 102*a*, 102*b* are placed in a firing configuration and a firing signal is sent from the surface system 110 via the wireline 116 to trigger the detonators in those fire-configured initiator circuits.

The surface system 110 includes an interlock circuit 110*a* that selectively connects the wireline 116 to various other surface components that may be present, such as a power supply 110*b*, a transceiver 110*c*, and a computer 110*d*. The interaction between the surface system 110 and the tool stack depends (at least in part) on the setting of the interlock circuit 110*a*. The interlock circuit 110*a* may be selectively placed in a "safe" configuration to disconnect the surface system 110 from the wireline 116 in order to prevent any electrical contact between the surface system 110 and the tools 150, 101*a*, 100*b* in the stack. Preferably, this configuration is the default. The interlock circuit 110*a* may be placed in a "fire" configuration to connect a firing circuit at the surface (perhaps a particular manually operated power supply 110*a*) to the wireline 116 such that the firing circuit may be operated to trigger detonation of the explosives. The interlock circuit 110*a* may be placed in one of potentially several "communication" modes to connect a power circuit (110*a*) and/or a transceiver circuit (110*c*) to the wireline 116 such as to enable communication with one or more of the tools in the stack.

FIGS. 2A-2D are functional block diagrams illustrating an exemplary interlock circuit 200 and magnetic key 206. The circuit 200 includes an array of magnet sensors (e.g., Hall-effect sensors) 204*a*-204*j* connected to a controller 202. The circuit 200 also includes one or more switches 216, 218 between the wireline 220 and other components of the surface system. For example, one switch 216 may have multiple poles each connecting to a different aspect of the surface system through an interface 208, 210, 212, 214. The key 206 includes an array of magnets 206*a*-206*d* ordered in a predetermined physical arrangement such that the key 206 may engage the circuit 200 in one or more configurations to align the magnets 206*a*-206*d* with certain sensors 204*a*-204*j*. The controller 202 is configured to detect the key 206 position and, based on this position, set the positions of one or more switches 216, 218 to control how the surface system is connected to the wireline 220 (and thus to the tool stack).

Figure 2A:
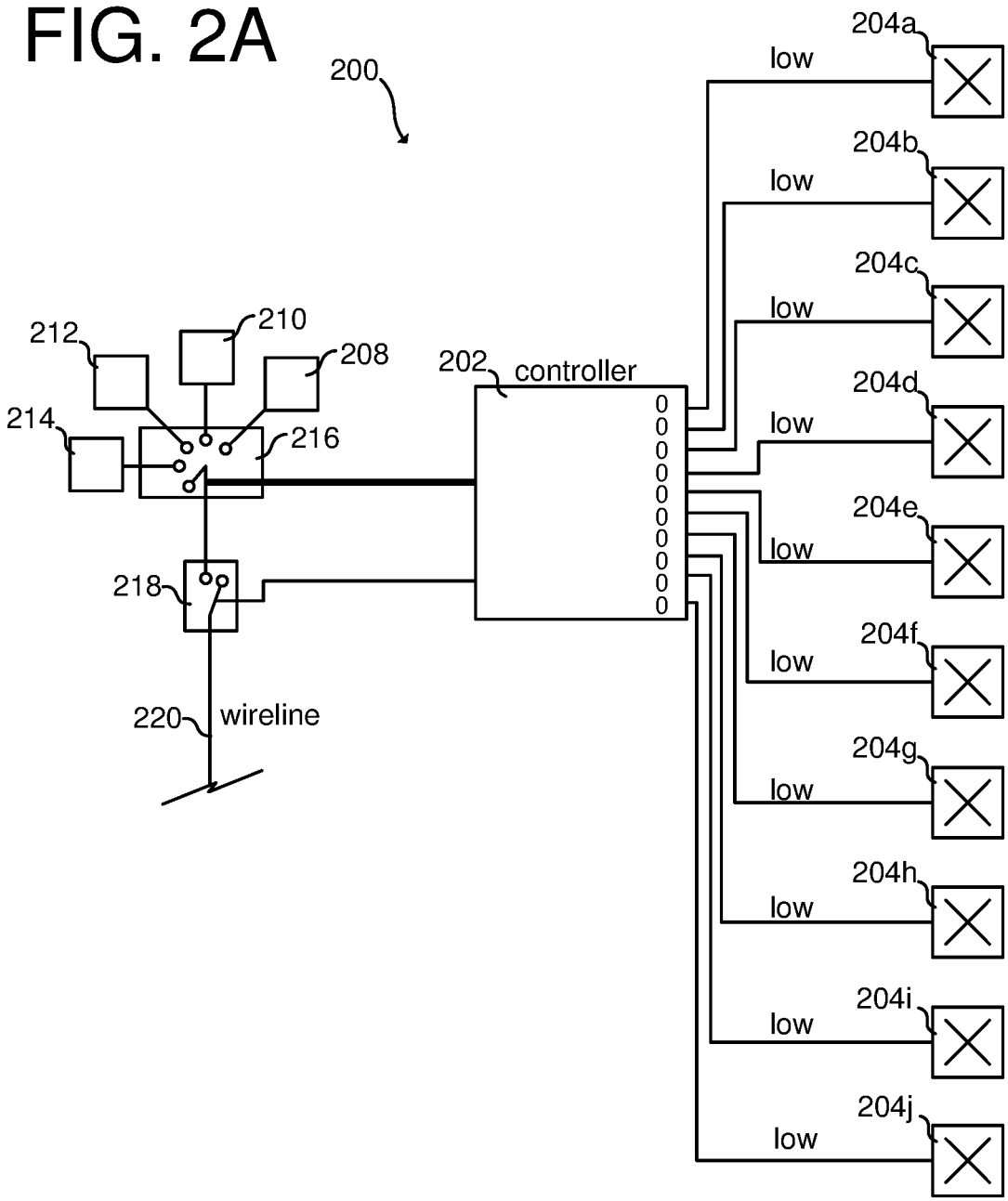
FIGS. 2A-2D are functional block diagrams illustrating an exemplary magnetic-key safety interlock circuit according to an aspect of the invention.

For example, the configuration depicted in FIG. 2A has the key 206 removed from the circuit 200. None of the sensors 204*a*-204*i* register the presence of a key magnet 206*a*-206*d*. The sensors 204*a*-204*j* may, e.g., register the absence of magnets by providing a "low" voltage signal to controller 202. The controller 202 may interpret these "low" signals as digital "0" and represent the sequence of sensor signals as a bit pattern (000000000 in FIG. 2A) that is interpreted to set the switches 216 and 218. In this example, the 000000000 bit pattern corresponds to a "no key" configuration and sets (or leaves) the switches 216, 218 in the "no key" state disconnecting the surface system from the wireline 220. In this state, no signals (firing or otherwise) may be sent from the surface system to the tool stack connected to the wireline.

Figure 2B:
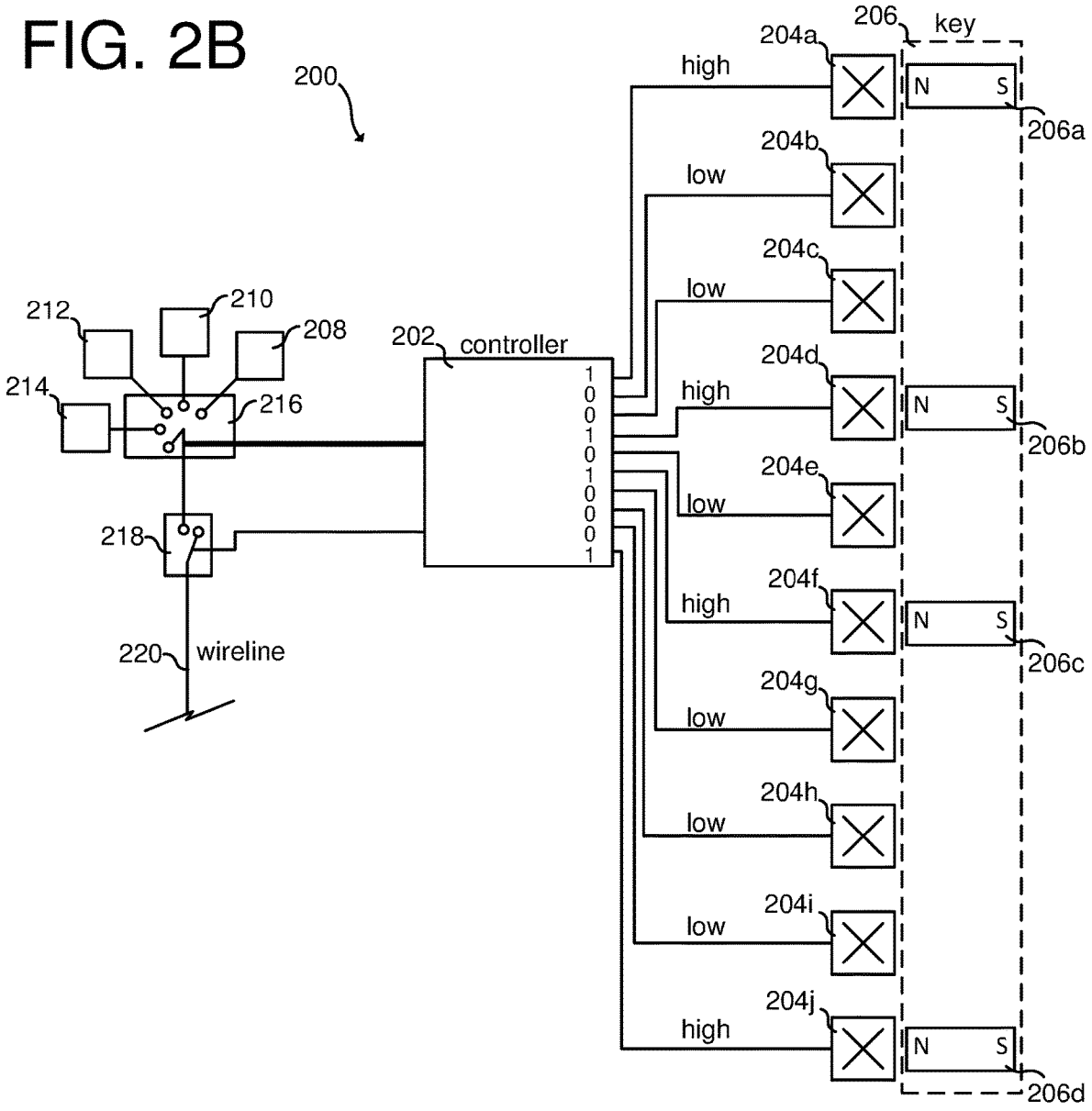

The exemplary configuration depicted in FIG. 2B has the key 206 positioned such that 4 magnets 206*a*-206*d* are positioned next to four sensors 204*a*, 204*d*, 204*f*, 204*j* such that these sensors 204*a*, 204*d*, 204*f*, 204*j* register the presence of the magnets 206*a*-206*d* but the other sensors 204*b*, 204*c*, 204*e*, 204*g*, 204*h*, 204*i* do not. The registering sensors 204*a*, 204*d*, 204*f*, 204*j* may, e.g., provide a "high" voltage signal to the controller 202 while the other sensors 204*b*, 204*c*, 204*e*, 204*g*, 204*h*, 204*i* provide a "low" voltage signal to the controller 202. The controller may interpret the "high" signals as digital "1" and the low signals as digital "0." The sequence of sensor signals depicts a particular position of the key 206 relative to the circuit 200. The sequence can, e.g., be represented as a bit pattern in the controller (1001010001 in FIG. 2B). In this example, the 1001010001 bit pattern corresponds to a "safe" configuration and sets (or leaves) the switches 216, 218 in the "safe" state disconnecting the surface system from the wireline 220. In this state, no signals (firing or otherwise) may be sent from the surface system to the tool stack connected to the wireline.

Figure 2C:
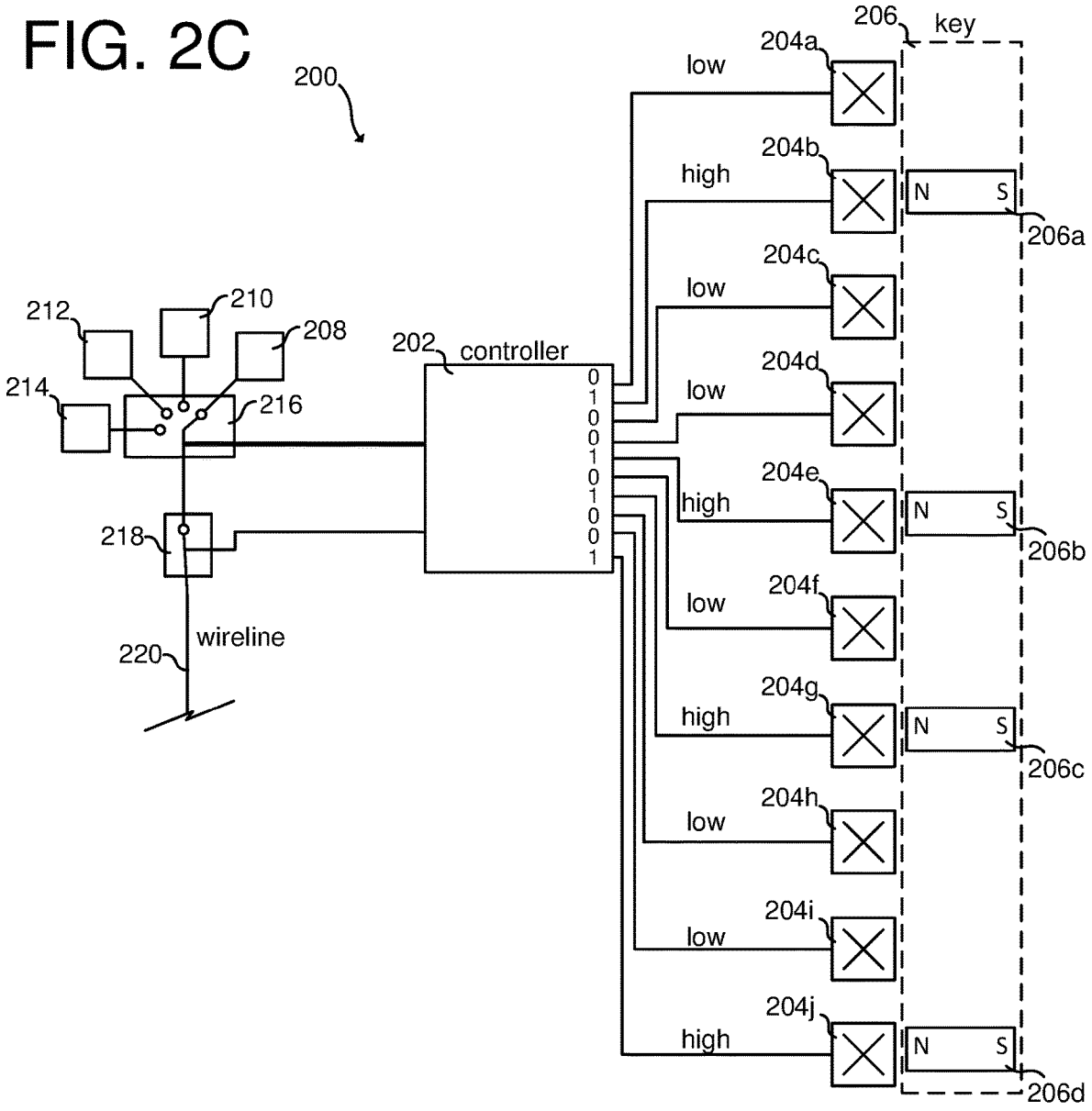

The exemplary configuration depicted in FIG. 2C has the key 206 positioned such that 4 magnets 206*a*-206*d* are positioned next to four sensors 204*b*, 204*e*, 204*g*, 204*j* such that these sensors 204*b*, 204*e*, 204*g*, 204*j* register the presence of the magnets 206*a*-206*d* but the other sensors 204*a*, 204*c*, 204*d*, 204*f*, 204*h*, 204*i* do not. The registering sensors 204*b*, 204*e*, 204*g*, 204*j* may, e.g., provide a "high" voltage signal to the controller 202 while the other sensors 204*a*, 204*c*, 204*d*, 204*f*, 204*h*, 204*i* provide a "low" voltage signal to the controller 202. The controller may interpret the "high" signals as digital "1" and the low signals as digital "0." The sequence of sensor signals depicts a particular position of the key 206 relative to the circuit 200. The sequence can, e.g., be represented as a bit pattern in the controller (0100101001 in FIG. 2C). In this example, the 0100101001 bit pattern corresponds to a "log" configuration and sets the switches 216, 218 in the "log" state connecting the wireline 220 to a transceiver and power supply of the surface system (via a "log" interface circuit 208) but not to the firing circuit of the surface system. In this state, certain signals other than the firing signal may be exchanged between the surface system and tool stack over the wireline 220.

Figure 2D:
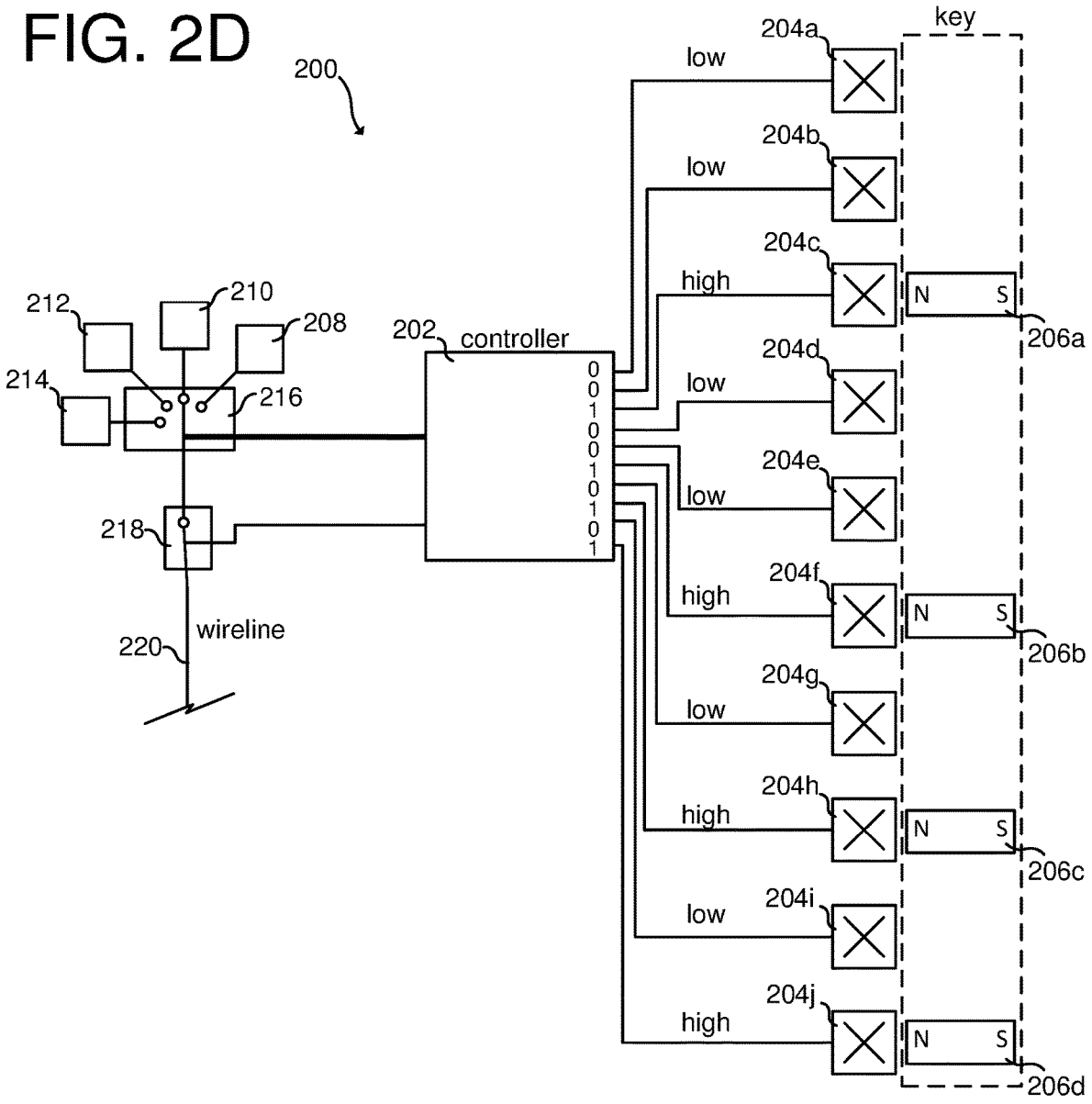

The exemplary configuration depicted in FIG. 2D has the key 206 positioned such that 4 magnets 206*a*-206*d* are positioned next to four sensors 204*c*, 204*f*, 204*h*, 204*j* such that these sensors 204*c*, 204*f*, 204*h*, 204*j* register the presence of the magnets 206*a*-206*d* but the other sensors 204*a*, 204*b*, 204*d*, 204*e*, 204*g*, 204*i* do not. This corresponds to a controller 202 bit pattern of 0010010101 which in turn corresponds to a "fire" configuration in which the switches 216, 218 are set to the "fire" state connecting the wireline 220 to a shooting power supply of the surface system (via a "fire" interface circuit 210). In this state, the firing signal may be sent from the surface system to the tool stack over the wireline 220.

Other key positions can be used to configure the switches 217, 218 to selectively connect aspects of the surface system to the wireline.

The circuits depicted in FIGS. 2A-2D as functional blocks may be implemented as distinct devices or not. For example, the controller 202 may include more than one physical device or may be implemented as single device. And multiple blocks may be implemented in a single device. The controller 202 may be implemented using one or more programmed processors, configured gate arrays or PLCs, digital circuits, analog circuits, or as a combination thereof. Likewise, the two switches 216, 218 may be implemented in a single physical device or as multiple physical devices. The switches 216, 218 may be implemented with any of a variety of devices known in the art, such as electromechanical switches, electromagnetic or solid-state relays, FETs, and multiplexers. Similarly, the interfaces 208, 210, 212, 214 may be distinct circuits that are connected only via the switch 216, they may be implemented as different configurations or subsets of a circuit, or they may be implemented as some combination thereof.

The magnet sensor signals may be inverted from the above description, and the presence of a magnet may correspond to a low voltage and the absence of the magnet may correspond to a high voltage. Other electronic signals may also be used, so long as the signal denoting the presence of the magnet is distinguishable from that denoting the absence of the magnet. The magnet sensors may provide analog signals to be digitized by the controller (e.g., using ADCs that are internal or external to a processor device) or the sensors may provide digital signals to the controller (or some sensors in the array may provide an analog signal while others provide a digital signal). A magnet sensor may be polarity sensitive and thus be able to detect the orientation of a magnet. For example, a sensor may be sensitive to whether the north or south pole of a dipole magnet is facing the sensor. For such a sensor, the sensor may, e.g., provide a 2-bit signal, one bit for the presence of the magnet a second bit for the dipole orientation of the magnet. Similarly, an orientation-sensitive sensor may provide different voltages representing the various conditions (e.g., 0V for no magnet, −5V for a magnet in first dipole orientation, +5V for a magnet in second dipole orientation) which may be converted into digital format (e.g., 00, 01, 11).

In some embodiments of the interlock circuit 200, the controller 202 may be configured to establish a path-dependent state machine that functions analogously to a combination lock. The controller may be configured to store the previous key position (or some number of previous key positions) and then set the switches 216, 218 based not only on the current key position but also using previous key positions. For example, the controller can be configured to never set the switches 216, 218 to the "fire" state unless the current key position is in the "fire" state and the immediately preceding key position was the "safe" state.

In some embodiments of the interlock circuit 200, the controller 202 may be configured to require a consistent key-position reading for some period of time before changing the interlock circuit 200 state to other than the "safe" position. For example, before changing the switches 216, 218 from a "safe" state to a "log" or "fire" (or other) state, the controller 202 may require a consistent key-state reading in that "log" or "fire" (or other) state for at least 30 ms. For example, any deviation of the key-position bit pattern in the trailing 30 ms will prevent changing the circuit 200 state out of the "safe" state. The controller 202 may be configured to immediately return the circuit 200 to the "safe" state upon any change in the key-position bit pattern.

Figure 3A:
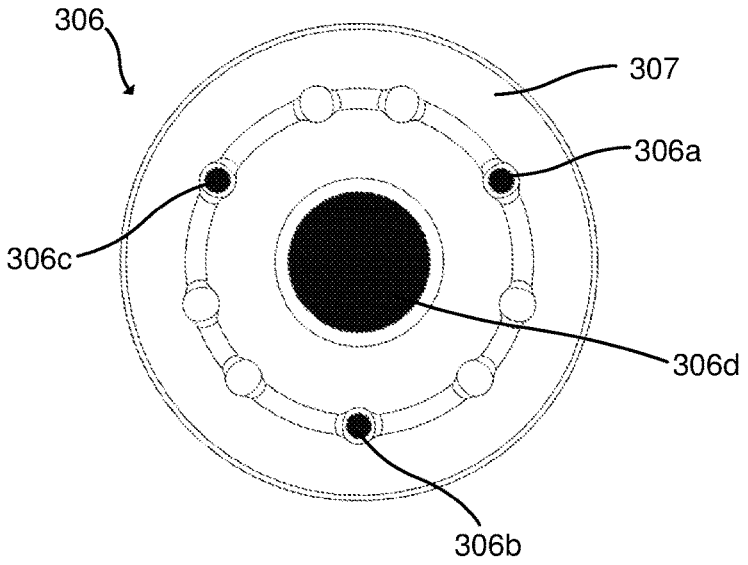
FIGS. 3A-3C are various views illustrating an exemplary magnetic-key according to an aspect of the invention.
Figure 3B:
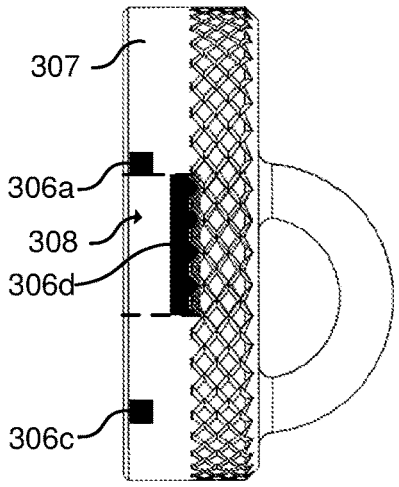
Figure 3C:
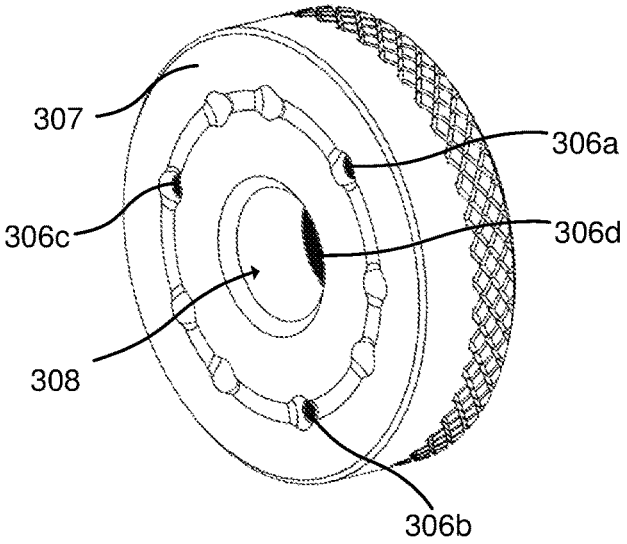

An exemplary magnetic key 306 is illustrated in FIGS. 3A-3D. FIG. 3A illustrates the front face of the key 306 showing four magnets 306*a*-306*d* (shown in black) disposed in a chassis 307. The magnets 306*a*-306*d* function as do the magnets 206*a*-206*d* described with reference to FIGS. 2A-2D. Further, one (or more) of the magnets may also serve to mount the key to the interlock circuit chassis (typically a circuit board). The key 306 includes a cylindrical mounting cavity 308 containing a mounting magnet 306*d*. FIG. 3B is a side view illustrating how the magnets 306*a*-306*d* (shown in black) are positioned in the chassis 307. (For clarity, the chassis 307 is depicted as if transparent.) FIG. 3C is a perspective view showing the front face of the key 306.

Figure 4A:
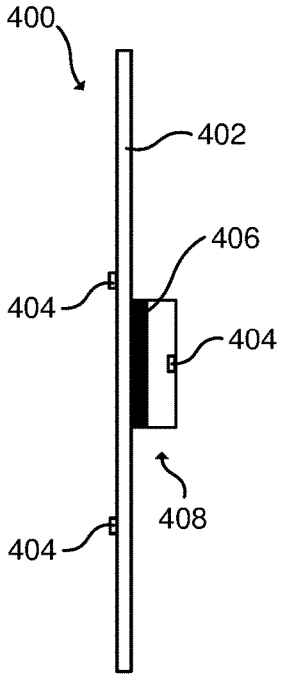
FIGS. 4A-4D are various views illustrating an exemplary interlock circuit key receptacle and corresponding magnetic key according to an aspect of the invention.

An exemplary receptacle 400 for the magnetic key 306 is illustrated in FIGS. 4A-4D. FIG. 4A is side view. The receptacle 400 includes a board 402, a number of magnet sensors 404 that function as do the sensors 204*a*-204*j* described with reference to FIGS. 2A-2D, a protruding cylindrical mount 408 that includes a sensor 404 and a mounting magnet 406 configured to engage a corresponding magnet 306*d* in the key 306. The mounting magnet 406 may be oriented to accept only keys having a corresponding magnet 306*d* with a compatible orientation. For example, the mounting magnet 406 may be a dipole magnet oriented with its north pole facing out from the board 402 toward the key 306 (when mounted). This would not retain a key 306 with a corresponding dipole magnet 306*d* with its north pole facing toward the board 402 when key 306 and receptacle 400 are mated. Rather, they would repel each other. In this way, keys and receptacles can be matched.

Figure 4B:
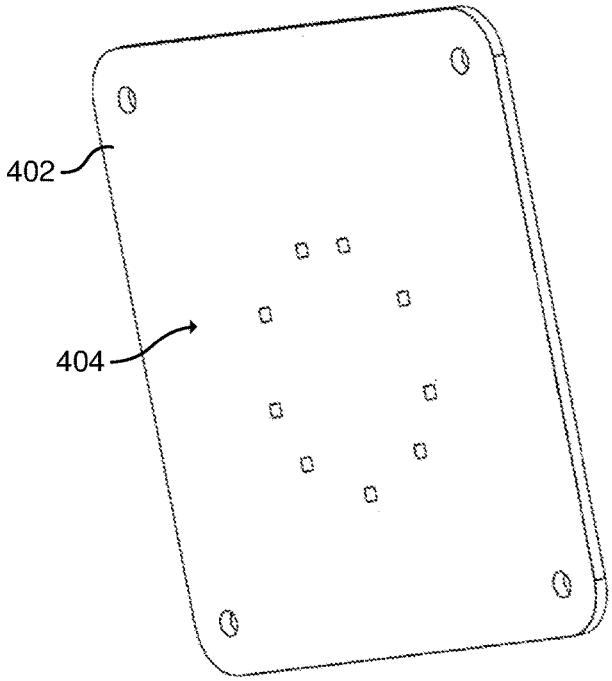
Figure 4C:
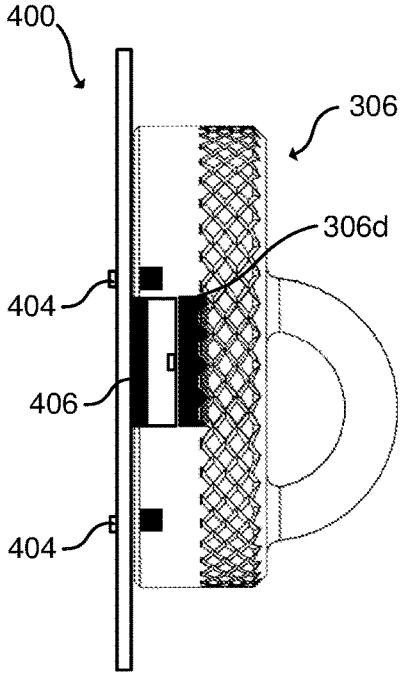
Figure 4D:
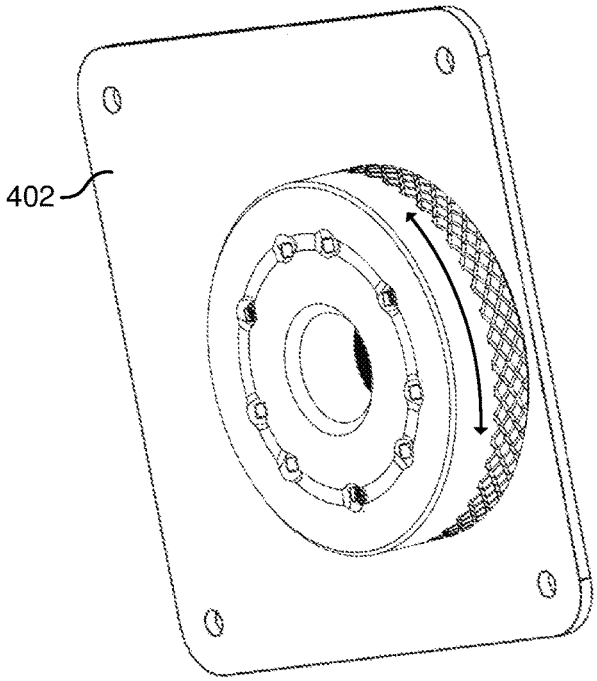

FIG. 4B is a perspective view showing a face of the board 402 and the sensors 404 (9 in this example) arrayed to correspond to the position of the magnets 306*a*-306*c* of the key 306. FIG. 4C is a side view illustrating a key 306 mounted to the receptacle 400 via the mount 408 and corresponding mounting magnets 406, 306*d* that are oriented to attract each other and thereby hold the key 306 to the board 402. (For clarity, the key 306 is depicted as if transparent.) The protruding mount 408 engages a corresponding cavity 308 of the key 306. FIG. 4D is a perspective view illustrating the key 306 mounted to the receptacle 400 via the mount 408 and corresponding magnets 406, 306*d*. (For clarity, the board 402 is depicted as if transparent.) As mounted, the key 306 is at least partially free to rotate about an axis of the protruding mount 408, as depicted by the curved arrow in FIG. 4D. By rotating the mounted key 306 about the mount 408 axis, the key magnets 306*a*, 306*b*, 306*c* may be positioned a different sensors 404 to set the interlock circuit in different states.

Other interlock circuit components may be mounted on the board 402 which may be configured as a printed circuit board. Alternatively, the mounting board 402 may hold only some or none of the interlock circuit components. In such an embodiment, some or all circuit components would be held by a separate mount (e.g., a printed circuit board) connected to the mounting board 402.

FIGS. 5A-5E illustrate an exemplary interlock circuit 500 in various states corresponding to key 606 positions depicted in FIGS. 6A-6E respectively. The circuit 500 is an implementation of the circuit 200 described above using two processors 502, 503 to implement the controller 202.

Figure 5A:
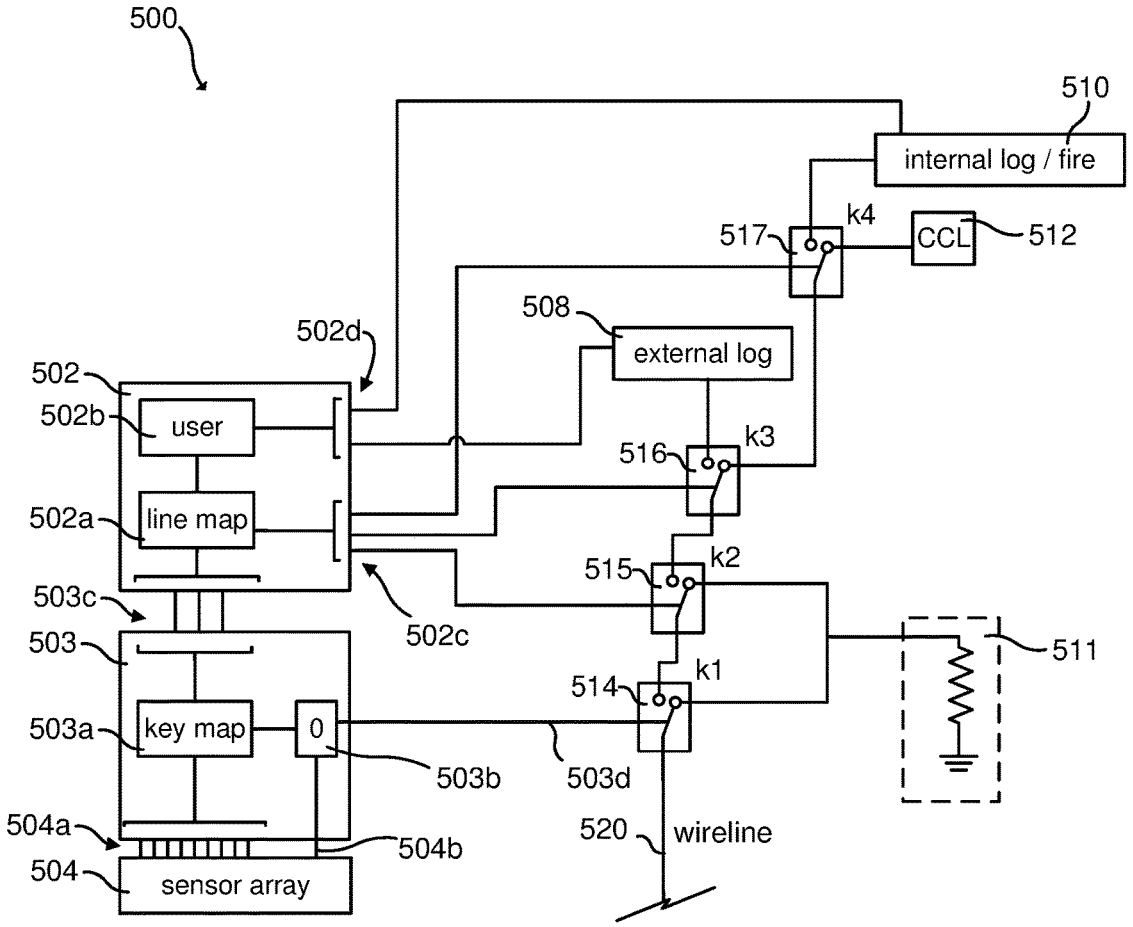
FIGS. 5A-5E are functional block diagrams illustrating an exemplary magnetic-key safety interlock circuit in various states corresponding to the key positions depicted in FIGS. 6A-6E respectively, according to an aspect of the invention.

FIG. 5A depicts the circuit 500 in the key-absent state. A key-position processor 503 receives signals from a magnet-sensor array 504 (geometrically similar to the array described with reference to FIGS. 4A-4D and functionally similar to the array described with reference to FIGS. 2A-2D). The sensor array 504 provides key-position signals 504*a* and a key-presence signal 504*b* to the key-position processor 503. The key-position processor 503 provides a relay-control signal 503*d* to relay k1 514 based on whether the processor 503 determines that the key-presence signal 504*b* indicates a key is present 503*b*: if the processor 503 determines a key is present, relay k1 514 is set to connect the wireline 520 to relay k2 515; if a key is not present, relay k1 514 is reset to connect the wireline 520 to a terminator circuit 511 (terminating the wireline to ground through a resistor).

Figure 6A:
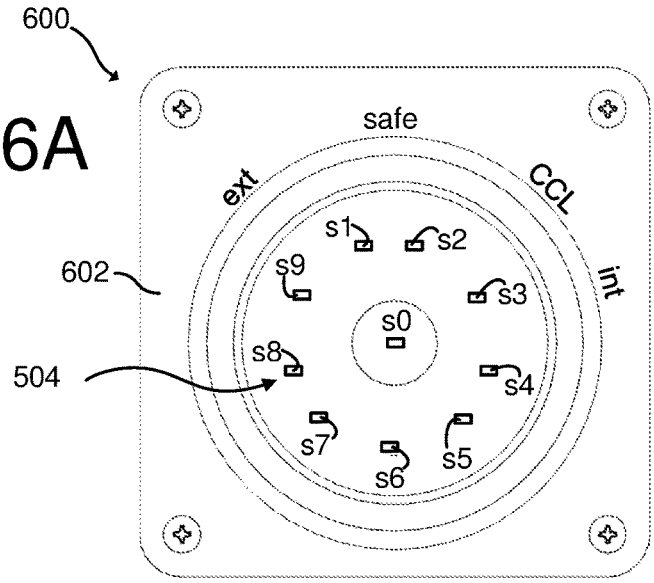
FIGS. 6A-6E illustrate various key positions corresponding to the interlock-circuit states depicted in FIGS. 5A-5E respectively.

FIG. 6A depicts a receptacle 600 including a mounting board 602, similar to the receptacle 400 and board 402 described with reference to FIGS. 4A-4D above, without a key. The sensor array 504 is depicted on the receptacle 600 as a roughly circular array of sensors with nine circumferential sensors s1-s9 and a central sensor s0. (The receptacle 600 is shown as transparent for sake of clarity.) As there is no key present, none of the sensors s0-s9 indicate the presence of magnet. (As illustrated in FIGS. 6A-6E, sensors shown as white boxes do not detect the presence of a key magnet and sensors shown as black boxes detect the presence of a key magnet.)

Figure 5B:
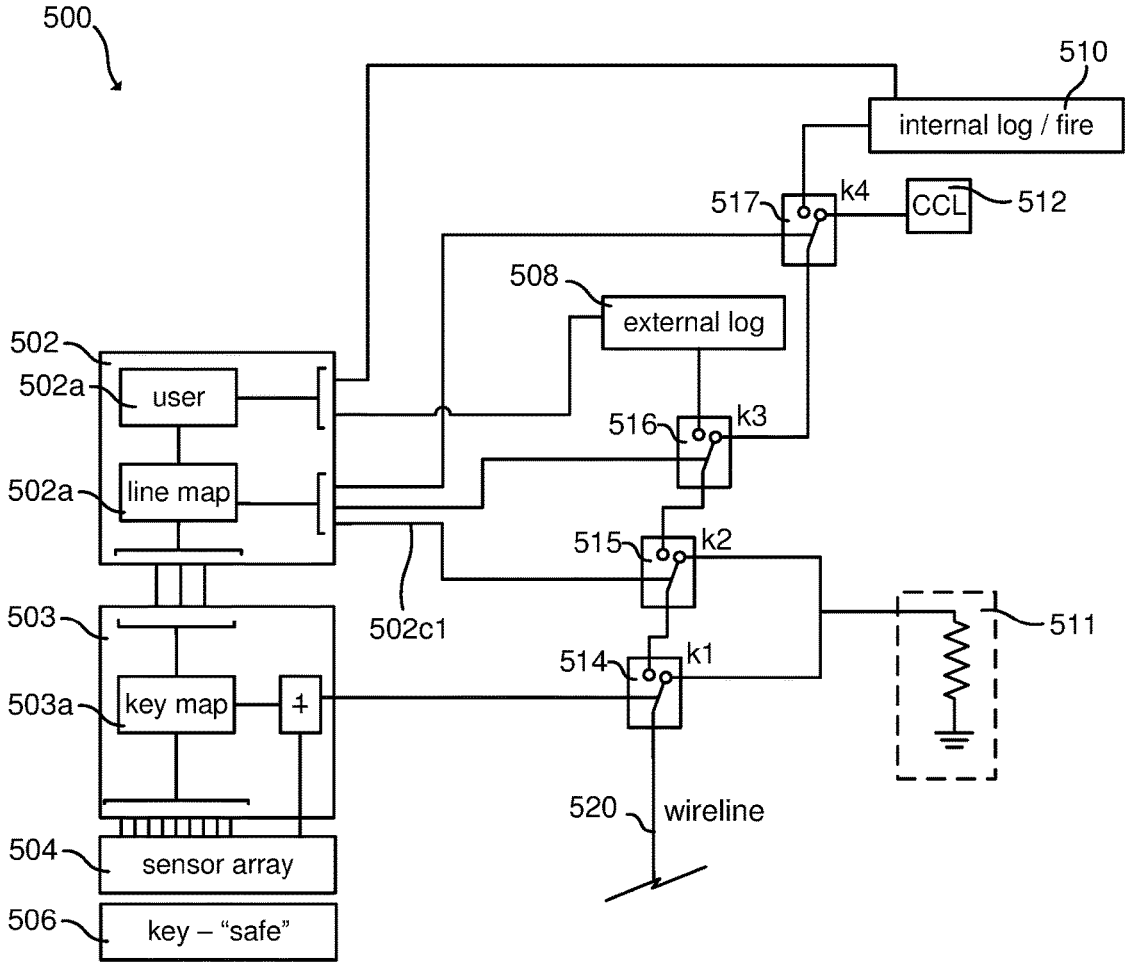
Figure 6B:
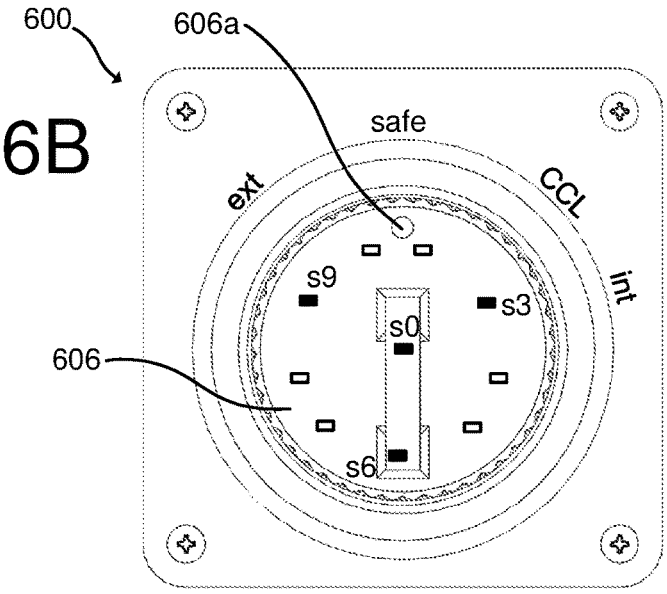

FIGS. 5B and 6B depict the interlock circuit 500 and key 606 in the "safe" state. The key-position processor 503 maps 503*a* the key-position signals 504*a* to key states: "external," "safe," "CCL," and "internal." The key-position processor 503 provides the key state information 503*c* to a line-configuration processor 502 which in turn provides switch-control signals 502*c* to control relays k2 515, k3 516, k4 517. FIG. 6B depicts the key 606 engaged with the receptacle 600. (The key 606 is shown as transparent for sake of clarity.) The key 606 may include a key-position marker 606*a* (shown oriented to the "safe" position denoted on the receptacle 600) for user convenience. The "safe" key position corresponds to four key magnets engaging four receptacle magnet-sensors. A central key-presence sensor s0 detects a central (mounting) magnet in the key 606 and provides a magnet-present signal to the key-position processor 503 which sets relay k1 514 as described above. Three key-position sensors s3, s6, and s9 detect magnets in the key 606. The activation of these three sensors s3, s6, and s9 with the deactivation of the remaining sensors s1, s2, s4, s5, s7, s8 indicate to the key-position processor 503 that the key is in the "safe" position. For example, this could be a bit pattern (s1-s9) of 001001001 (or 110110110 for an active-low signal). The key map 503*a* recognizes this bit pattern (e.g., through a table lookup or case statement) as the "safe" state and communicates this state to the line-configuration processor 502 which in turn maps the "safe" state to relay-control signals 502*c* such that the signal 502*c*1 controlling relay k2 515 is such as to reset relay k2 515 and connect the wireline 520 to the terminator circuit 511. As shown in FIG. 5B, the "safe" state may prevent a magnet-present signal from sensor s0 from setting relay k1. For all states described herein, setting the k1 relay may require both a magnet-present signal from the key-presence sensor s0 and a valid key-position state other than a "safe" state from the key-position sensor array s1-s9.

Figure 5C:
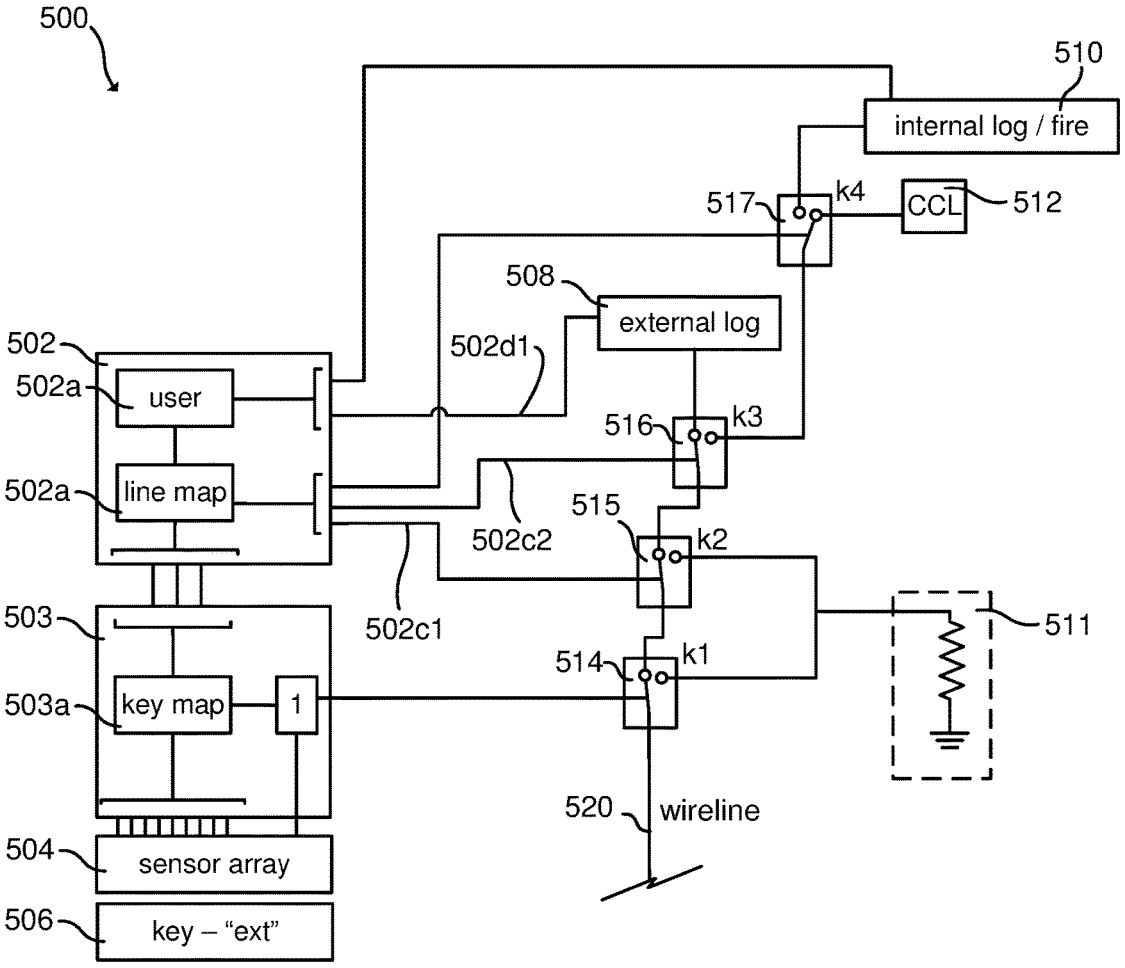
Figure 6C:
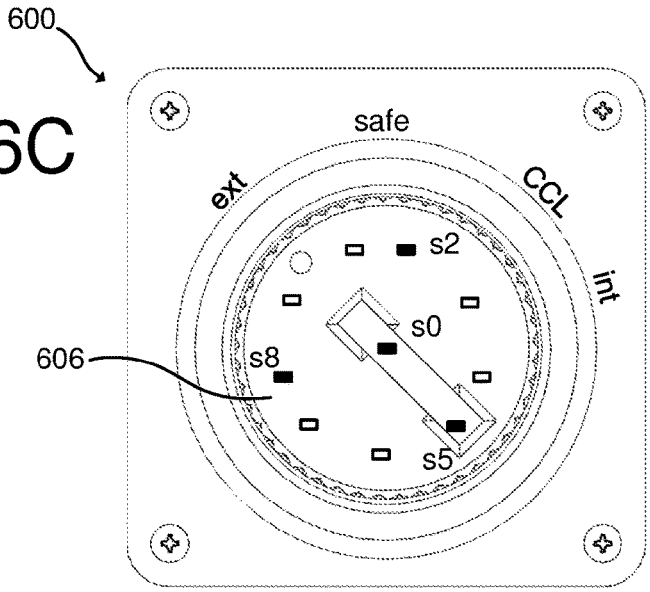

FIGS. 5C and 6C depict the interlock circuit 500 and key 606 in the "external" state. The "external" key position corresponds to four key magnets engaging four receptacle magnet-sensors. A central key-presence sensor s0 detects a central (mounting) magnet in the key 606 and provides a magnet-present signal to the key-position processor 503 which sets relay k1 514 to connect the wireline 520 to relay k2 515. Three key-position sensors s2, s5, and s8 detect magnets in the key 606. The activation of these three sensors s2, s5, and s8 with the deactivation of the remaining sensors s1, s3, s4, s6, s7, s9 indicate to the key-position processor 503 that the key is in the "external" position. For example, this could be a bit pattern (s1-s9) of 010010010 (or 101101101 for an active-low signal). The key map 503*a* recognizes this bit pattern as the "external" state and communicates this state to the line-configuration processor 502 which in turn maps the "external" state to relay-control signals 502*c* such that the signal 502*c*1 controlling relay k2 515 is such as to set relay k2 515 and connect the wireline 520 to relay k3 516 and the signal 502*c*2 controlling relay k3 516 is such as to set relay k3 516 and connect the wireline 520 to an "external" interface circuit 508 (e.g., an interface to a telemetry/power/computer system for logging). The line-configuration processor 502 may be configured to combine the key-position information with user input to provide 502*a* a signal 502*d*1 to configure the external interface circuit 508 (e.g., to set an impedance setting for the external system).

Figure 5D:
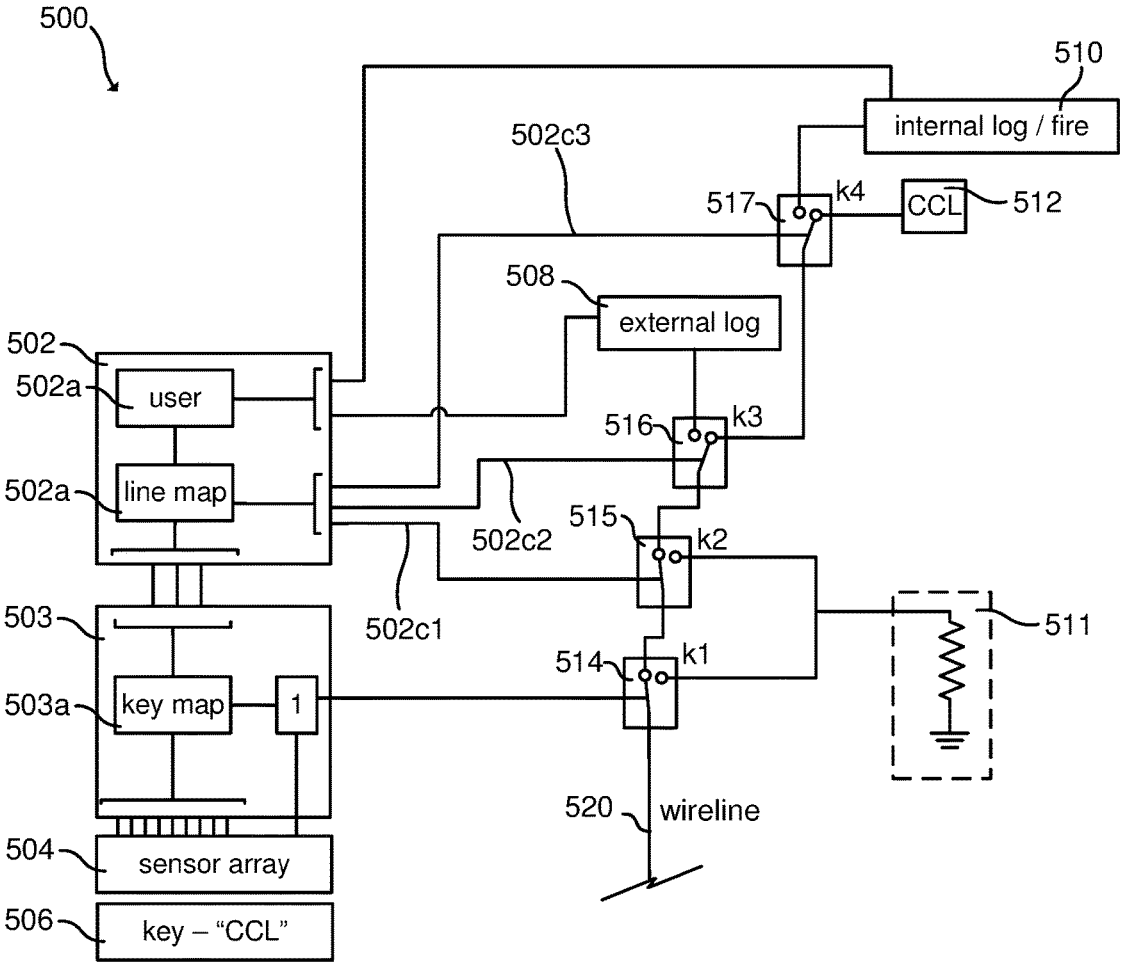
Figure 6D:
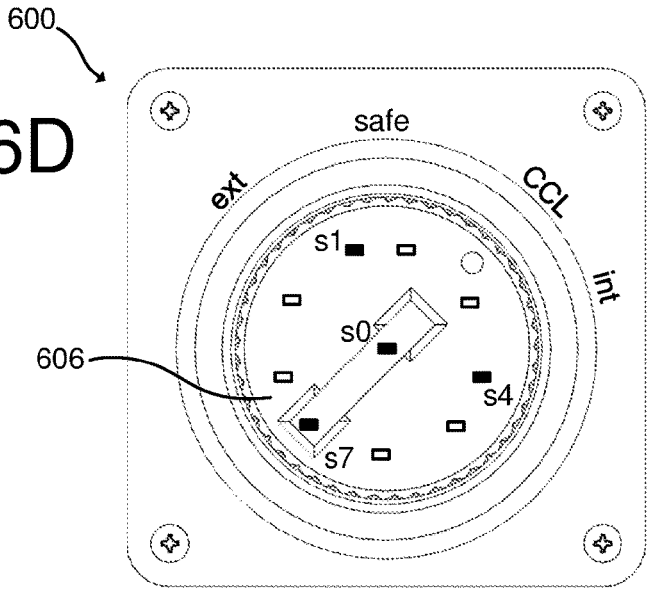

FIGS. 5D and 6D depict the interlock circuit 500 and key 606 in the "CCL" state. The "CCL" key position corresponds to four key magnets engaging four receptacle magnet-sensors. A central key-presence sensor s0 detects a central (mounting) magnet in the key 606 and provides a magnet-present signal to the key-position processor 503 which sets relay k1 514 to connect the wireline 520 to relay k2 515. Three key-position sensors s1, s4, and s7 detect magnets in the key 606. The activation of these three sensors s1, s4, and s7 with the deactivation of the remaining sensors s2, s3, s5, s6, s8, s9 indicate to the key-position processor 503 that the key is in the "CCL" position. For example, this could be a bit pattern (s1-s9) of 100100100 (or 011011011 for an active-low signal). The key map 503*a* recognizes this bit pattern as the "CCL" state and communicates this state to the line-configuration processor 502 which in turn maps the "CCL" state to relay-control signals 502*c* such that the signal 502*c*1 controlling relay k2 515 is such as to set relay k2 515 and connect the wireline 520 to relay k3 516, the signal 502*c*2 controlling relay k3 516 is such as to reset relay k3 516 and connect the wireline 520 to relay k4 517, and the signal 502*c*3 controlling relay k4 517 is such as to reset relay k4 517 and connect the wireline 520 to a CCL interface circuit 512 (an interface to a casing-collar-locator system).

Figure 5E:
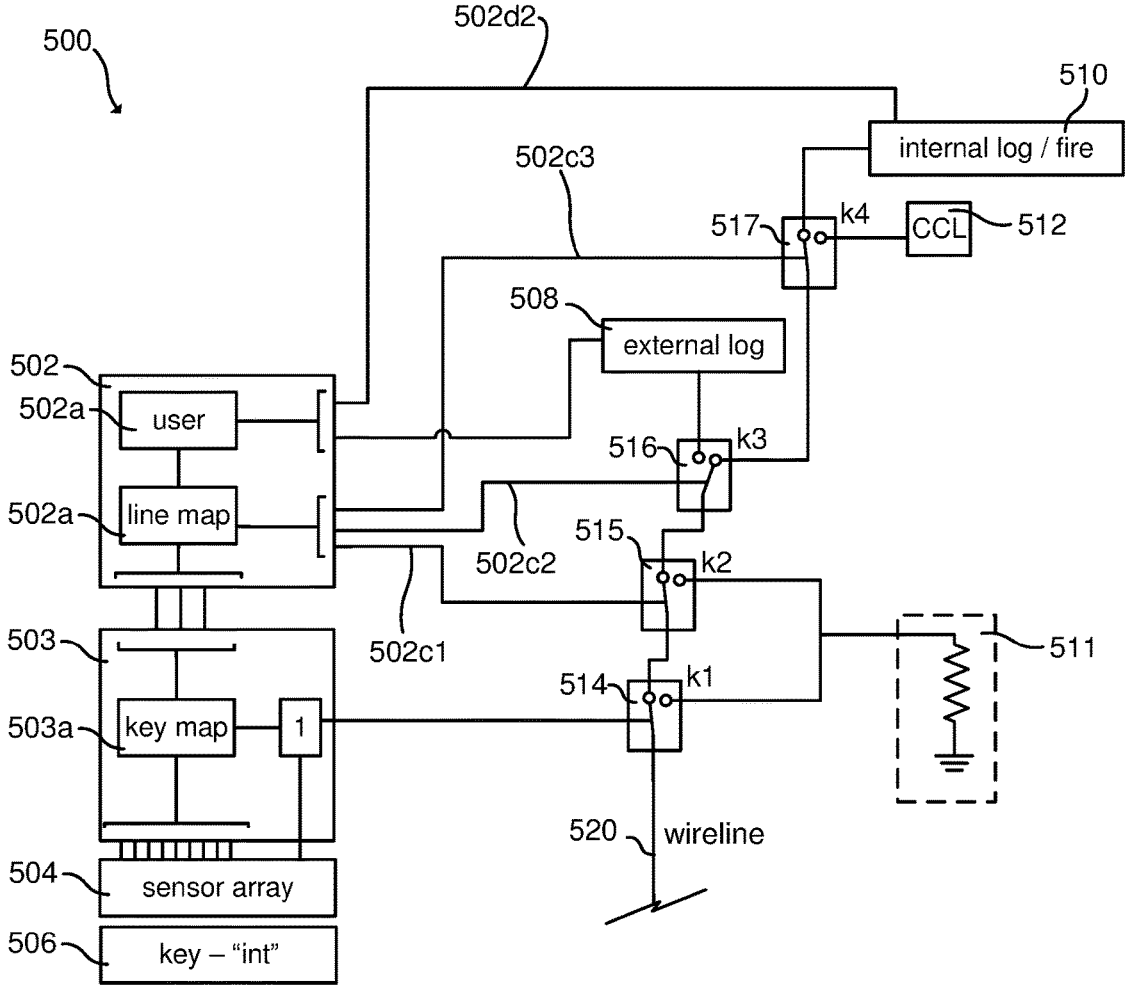
Figure 6E:
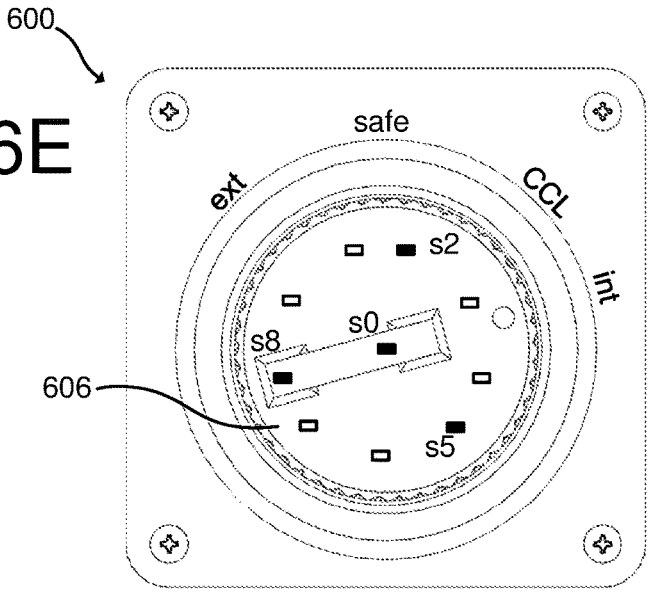

FIGS. 5E and 6E depict the interlock circuit 500 and key 606 in the "internal" state. The "internal" key position corresponds to four key magnets engaging four receptacle magnet-sensors. A central key-presence sensor s0 detects a central (mounting) magnet in the key 606 and provides a magnet-present signal to the key-position processor 503 which sets relay k1 514 to connect the wireline 520 to relay k2 515. Three key-position sensors s2, s5, and s8 detect magnets in the key 606. The activation of these three sensors s2, s5, and s8 with the deactivation of the remaining sensors s1, s3, s4, s6, s7, s9 indicate to the key-position processor 503 that the key is in the "internal" position. For example, this could be a bit pattern (s1-s9) of 010010010 (or 101101101 for an active-low signal). The key map 503*a* recognizes this bit pattern as the "internal" state and communicates this state to the line-configuration processor 502 which in turn maps the "internal" state to relay-control signals 502*c* such that the signal 502*c*1 controlling relay k2 515 is such as to set relay k2 515 and connect the wireline 520 to relay k3 516, the signal 502*c*2 controlling relay k3 516 is such as to reset relay k3 516 and connect the wireline 520 to relay k4 517, and the signal 502*c*3 controlling relay k4 517 is such as to set relay k4 517 and connect the wireline 520 to a to an "internal" interface circuit 510 (e.g., an interface to a telemetry/power/computer system for communicating with the tool stack and firing guns in the stack). The line-configuration processor 502 may be configured to combine the key-position information with user input to provide 502*a* a signal 502*d*2 to configure the internal interface circuit 510 for communication or firing. For example, when the key 606 is in the "internal" position and the user requests a firing mode of operation, the line-configuration processor 502 may set a switch (e.g., relay or FET) to connect a power supply to the wireline 520 along a path to provide sufficient voltage and current to trigger the explosives in the tool stack. Similarly, when the key 606 is in the "internal" position and the user requests a communication (logging) mode of operation, the line-configuration processor 502 may reset the switch to connect a different power supply to the wireline 520 or change the path from the power supply to the wireline 520 to attenuate or fuse-protect the power to attenuate the voltage and/or current to levels below the explosive-triggering level.

In the embodiment of the FIGS. 5A-5E, 6A-6E, the sensors s0-s9 may be implemented as analog-output sensors or digital-output sensors. For example, sensor s0 may provide an analog signal and the other sensors s1-s9 may provide a digital signal. Analog sensors signals may be converted to digital signals with one or more ADCs, which may be integrated into the key-position processor 503 or may be a separate component(s).

In the exemplary embodiments described above, a single sensor and a single magnet is used to establish the presence or absence of a key. Alternatively, multiple sensors/magnets may be used (perhaps in varying polarities) for this purpose. Keys could be matched (keyed) to receptacles based on the geometric/polarity configuration of the presence/absence key magnet array and corresponding receptacle sensor array. For example, the sense magnet array may be 3 dipole magnets each of which may be configured in one of two polarity states (represented here by "0" and "1"). This 3-magnet array may be configured in a wide variety of geometric configurations (e.g., linear equal spacing, linear unequal spacing, various triangular arrangements) and in eight different polarity permutations (000, 100, 010, 001, 110, 101, 011, 111). A sensor may note the presence of the magnet (e.g., "0"=absent, "1"=present) and polarity if present (e.g., "0" or "1") such that each magnet may be represented by two bits. A key-sense sensor array may be matched geometrically with a magnet array and the interlock system may require a certain polarity pattern to recognize a key as a proper key (e.g., sensors may be configured to detect magnets only of a certain polarity or sensors may return polarity information while the controller determines the polarity pattern).

In the exemplary embodiments described above, nine sensors and three magnets are used to establish the state of the key. The interlock circuit requires both the absence of a magnet for some sensors and the presence of the magnet for other sensors to establish a state. This is useful to prevent inadvertent or malicious activation of a state since the position magnet array is geometrically keyed to the position sensor array.

Figure 7:
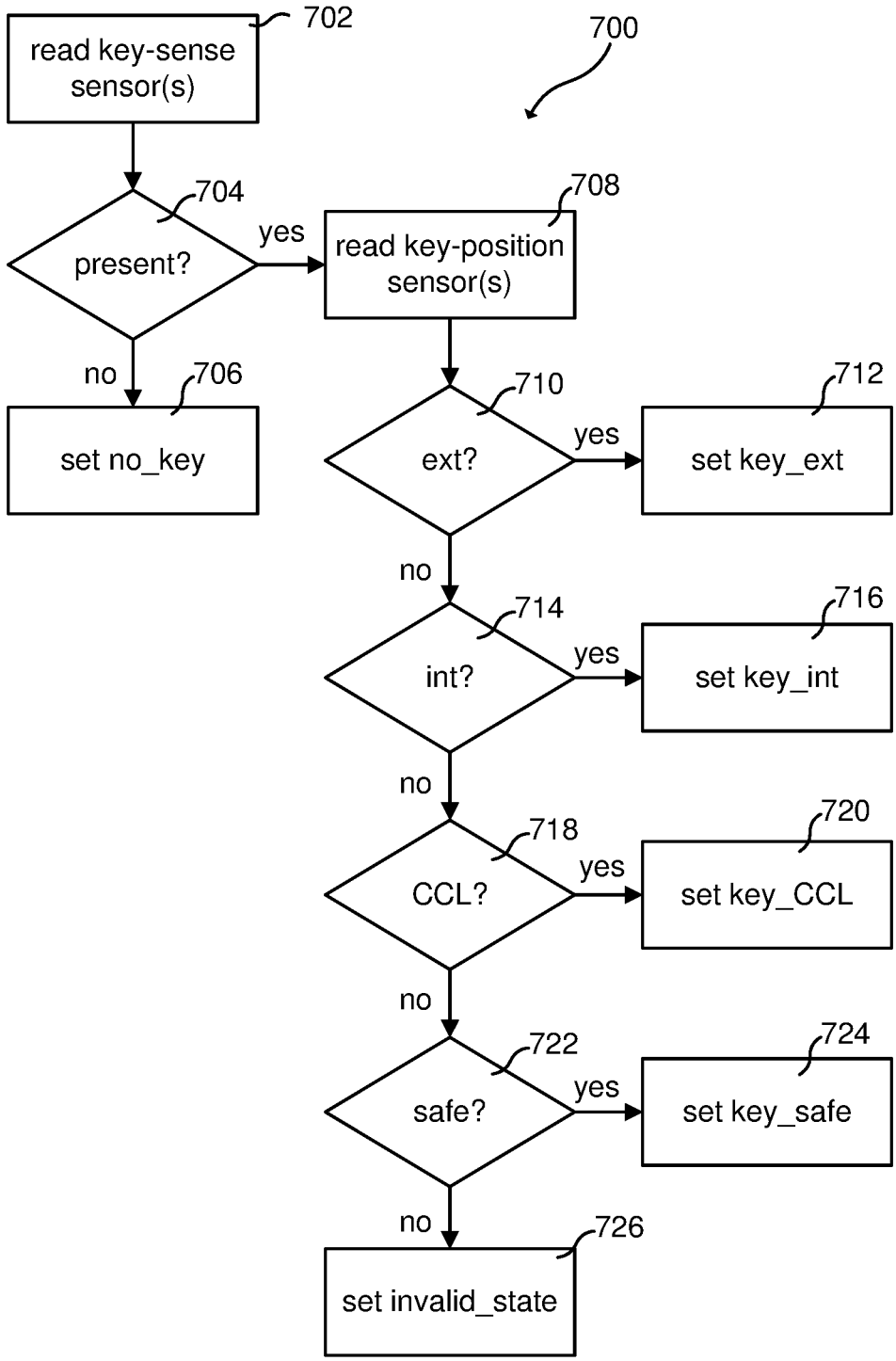
FIG. 7 illustrates an exemplary interlock-circuit control flow according to an aspect of the invention.

FIG. 7 illustrates an exemplary interlock-circuit control flow for determining a key position 700 (for sake of convenience in this description, this process is referred to as Key_Read and it returns a key_position value). The key-sense sensor (e.g., sensor s0 in FIGS. 5A-5E, 6A-6E) is read 702 and the reading is interpreted to determine if a key is present 704. For example, if the reading is a digital reading, then the presence of the key may be a bit (e.g., "1"=present, "0"=absent) or a bit array if polarity and/or multiple presence magnets are used. If the reading is an analog reading, then the presence of the key may be a range of voltages (e.g., >3.5V OR<0.4V) which may be determined, e.g., with a voltage comparator or digitally using ADC values. If there is no key, then the key status is set to reflect that there is not a key present 706 (e.g., key_position=no_key).

If the key is present, then the key-position sensor array is read 708. For example, if the position-sensor values are digital, then the reading could be represented as a bit pattern (which may be represented in code, e.g., by setting the value of a multi-bit variable to reflect the sensor pattern). If the position-sensor values are analog, then they may be processed as described for the key-sense sensor, ultimately to be reflected as a bit pattern or variable. The position-sensor values are then compared to predetermined values for known states 710, 714, 718, 722. This may be implemented in code, e.g., as a switch/case statement or a nested series of if/then checks. If the position-sensor value corresponds to the "external" state 710 then the key status is set to reflect that the key is in the "external" position 712 (e.g., key_position=key_ext). If the position-sensor value corresponds to the "internal" state 714 then the key status is set to reflect that the key is in the "internal" position 716 (e.g., key_position=key_int). If the position-sensor value corresponds to the "CCL" state 718 then the key status is set to reflect that the key is in the "CCL" position 720 (e.g., key_position=key_CCL). If the position-sensor value corresponds to the "safe" state 722 then the key status is set to reflect that the key is in the "safe" position 724 (e.g., key_position=key_safe). The system may include more or fewer states than are presented here (e.g., perhaps the CCL state is not desired or perhaps there are internal_log and internal_fire states that correspond to different key positions and line configurations). Ultimately, the position-sensor value is compared with all predetermined valid states (or until it matches a predetermined valid state). The system notes if the position-sensor value does not match any predetermined valid state 726 (e.g., key_position=invalid_state).

Figure 8:
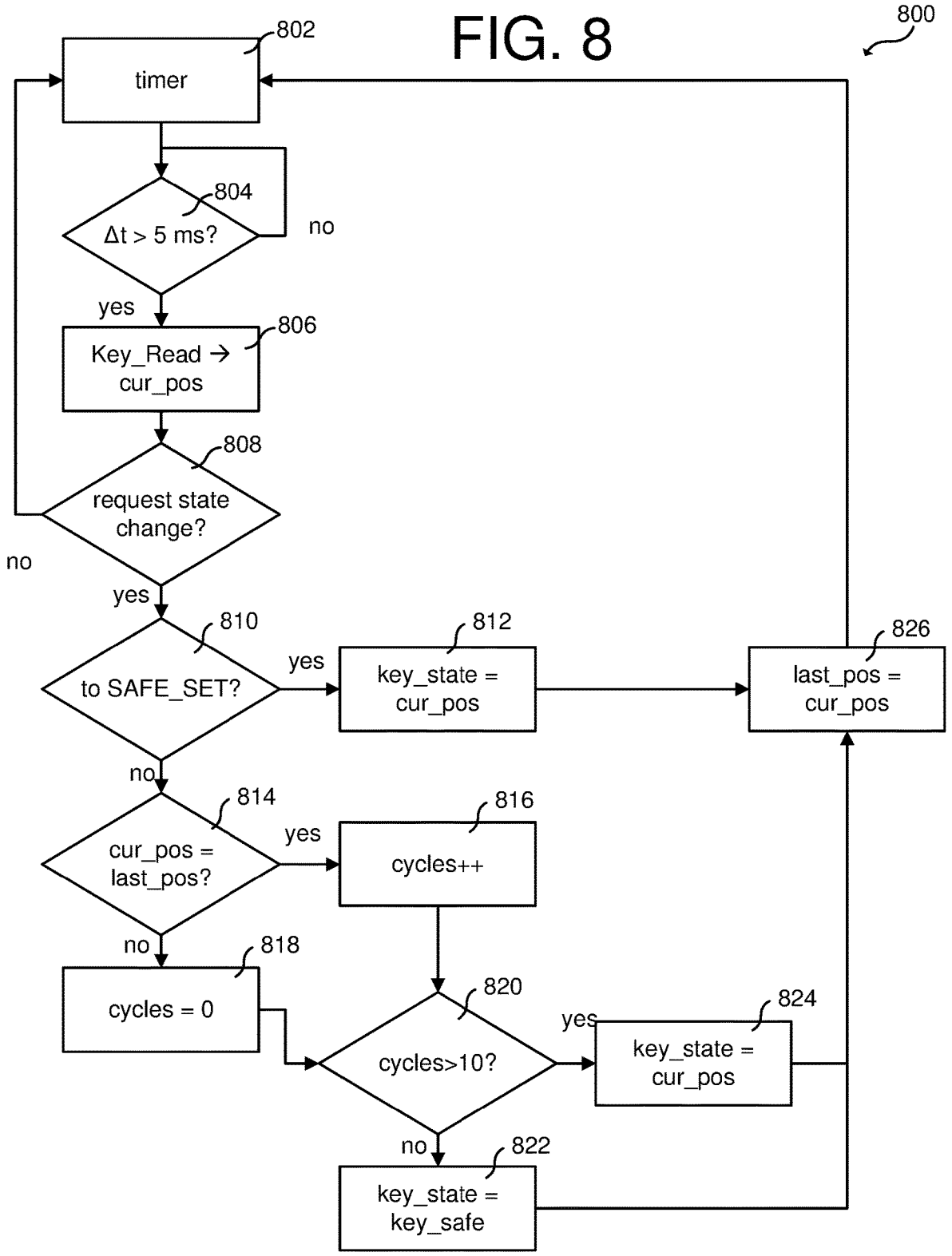
FIG. 8 illustrates an exemplary interlock-circuit control flow according to an aspect of the invention.

FIG. 8 illustrates an exemplary interlock-circuit control flow for continuously monitoring and appropriately updating a key state in the interlock circuit 800. (For sake of convenience in this description, this process is referred to as Key_Monitor and it returns a key_state value.) In this process, the key state reflects the key position only if certain conditions are met. If the key position is changed to the "safe" position or is removed or set in an invalid position (collectively, the SAFE_SET), then the key state is updated to the current key position. If the key position is changed to a valid position other than the "safe" position, such as "internal," "external," or "CCL" (collectively, the !SAFE_SET), the key state will not be updated until after the key position is determined to be in that position for longer than some predetermined amount of time (or is consistently measured in that position over some predetermined number of readings).

In the Key_Monitor process 800, the key position is read periodically with reference to a timer 802. The process checks if it has been greater than a predetermined amount of time since the last read 804. (Here, the predetermined amount of time is set to 5 ms.) If not, it returns to again check the timer. If so, then the current key position (cur_pos) is read 806 (by invoking the Key_Read process 700). The Key_Monitor process 800 determines if the current key position reflects a different key state than the current key state (key_state) 808. If the key position represents a different state than the current key state, the process 800 interprets this as a request to change the key state. If the current key position is of the SAFE_SET (no_key, invalid_state, key_safe) 810, then the key state is set to the current key-position state 812. Otherwise, the current key position is compared to the last key position 814: (1) if they are the same, then the number of times the key has been consecutively read in the same position (cycles) is updated 816; (2) if they are not the same, then the number of times the key has been consecutively read in the same position is set to zero 818. If the number of times the key has been consecutively read in the same position is greater than some predetermined number 820, then the key state is set to the requested state 824. If not, then the key state is set to the "safe" state 822. (Here, the predetermined number of cycles is set to 10.) After the key state has been set in response to a request to change the key state, the last key position is updated to the current key position 826 and the next read of the key position is performed after an adequate amount of time has passed 804, 806.

The Key_Monitor flow 800 may include steps to record when the key is placed in the "safe" position and to require, before processing a change in a key position to a position in the !SAFE_SET, that the immediately preceding read key position was the "safe" position. For example, instead of simply requiring a sufficient number of consecutive readings of an "internal" key position (e.g., cycles>10) to update the key state to "internal," the process can require both the sufficient consecutive readings and that the key position read immediately preceding the change to the "internal" key position was the "safe" position.

Figure 9:
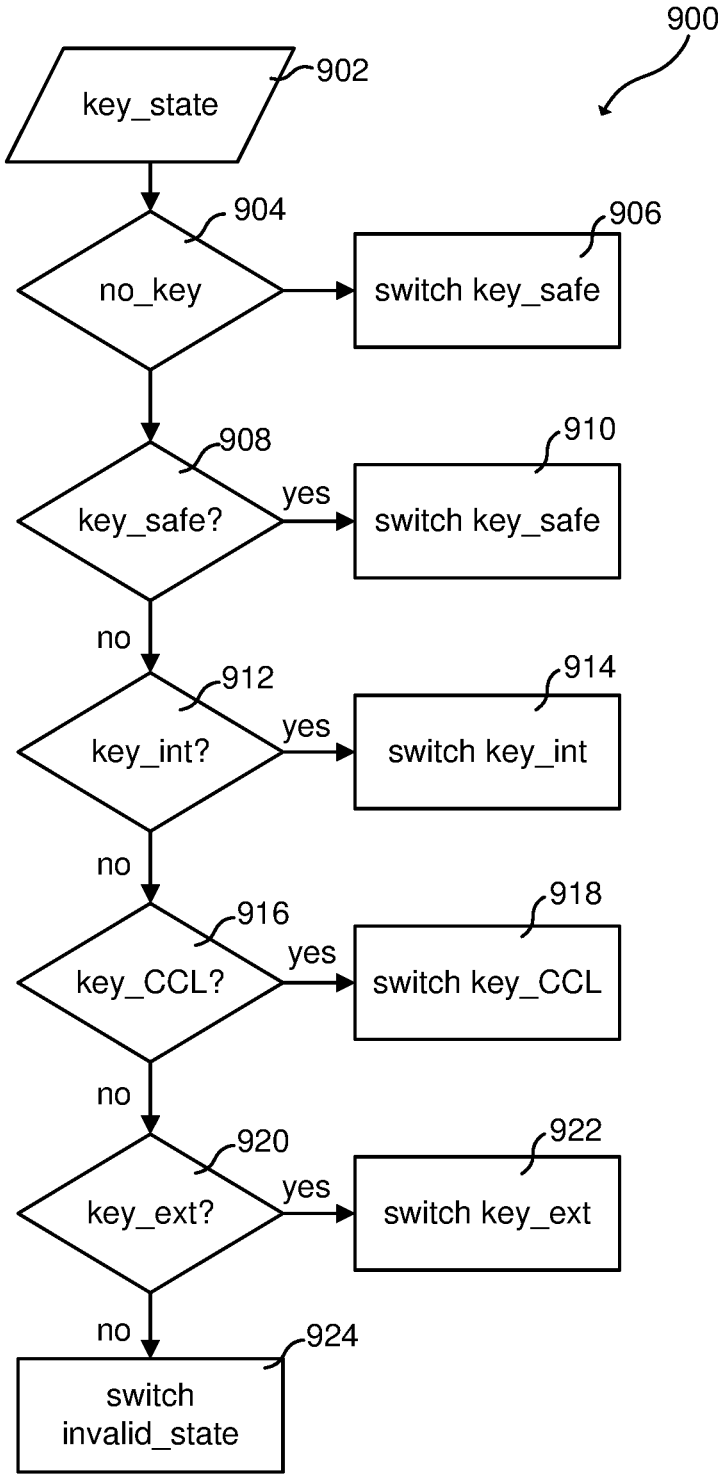
FIG. 9 illustrates an exemplary interlock-circuit control flow according to an aspect of the invention.

FIG. 9 illustrates an exemplary interlock-circuit control flow for updating switches in response to a change of key state 900. (For sake of convenience in this description, this process is referred to as Line_Update. The output is the set of switch-control signals to establish the associated switch states.) The Line_Update flow 900 receives the key state generated by Key_Monitor 902. The received key state is compared with the known key states and when the key state is identified with a known key state, the process generates the switch-control signals associated with that state. If in the no-key state 904, the process provides the switch-control signals required to terminate the wireline 906. If in the "safe" state 908, the process provides the switch-control signals required to terminate the wireline 910. If in the "internal" state 912, the process provides the switch-control signals required to connect the wireline to the "internal" interface circuit 914. If in the "CCL" state 916, the process provides the switch-control signals required to connect the wireline to the "CCL" interface circuit 918. If in the "external" state 920, the process provides the switch-control signals required connect the wireline to the "external" interface circuit 922. If in an invalid state 924, the process provides the switch-control signals required to terminate the wireline 926.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. An interlock system comprising:

(a) a first electrically controllable switch having at least two positions;

(b) a second electrically controllable switch having at least two positions;

(c) a magnet-sensor array comprising at least three magnet sensors arranged in a geometric array, wherein each magnet sensor has at least two states, each state corresponding to a unique electrical output; and (d) a controller electrically connected to the magnet-sensor array, to the first electrically controllable switch, and to the second electrically controllable switch;

(e) wherein the controller is configured to:

(i) determine a presence state of the magnet-sensor array by measuring, for each of one or more of the at least three magnet sensors, the electrical output of that magnet sensor;

(ii) determine, based on the presence state of the magnet-sensor array, a presence-state position for the first electrically controllable switch;

(iii) determine a presence-state electrical signal to provide to the first electrically controllable switch to set the first electrically controllable switch in the presence-state position; and (iv) provide the presence-state electrical signal to the first electrically controllable switch to set the first electrically controllable switch in the presence-state position.

2. The interlock system of claim 1 wherein the controller is further configured to:

(a) determine a position state of the magnet-sensor array by measuring, for each of two or more of the at least three magnet sensors, the electrical output of that magnet sensor;

(b) determine, based on the position state of the magnet-sensor array, a position-state position for the second electrically controllable switch;

(c) determine a position-state electrical signal to provide to the second electrically controllable switch to set the second electrically controllable switch in the position-state position; and (d) provide the position-state electrical signal to the second electrically controllable switch to set the second electrically controllable switch in the position-state position.

3. The interlock system of claim 1 wherein the controller is further configured to:

(a) determine a position state of the magnet-sensor array by measuring, for each of two or more of the at least three magnet sensors, the electrical output of that magnet sensor; and (b) determine, based on the presence state of the magnet-sensor array and the position state of the magnet-sensor array, the presence-state position for the first electrically controllable switch.

4. The interlock system of claim 1 wherein the magnet sensors are Hall-effect sensors.

5. The interlock system of claim 1 wherein the first and second electrically controllable switches each comprise at least one of the group consisting of an electromagnetic relay, a solid-state relay, an electromechanical switch, a field-effect transistor, and a multiplexer.

6. The interlock system of claim 1 wherein the controller includes a processor circuit.

7. The interlock system of claim 1 wherein the controller includes an analog-to-digital converter connected to at least one of the magnet sensors and wherein the magnet sensor connected to the analog-to-digital converter is configured to provide an analog output signal.

8. The interlock system of claim 1 wherein the second electrically controllable switch is comprised of at least two two-position switches connected in series.

9. The interlock system of claim 1 wherein the magnet-sensor array includes ten magnet sensors arranged roughly in the form of an elliptical array in which nine of the magnet sensors are disposed on the circumference of an ellipse and one of the magnet sensors is disposed within the circumference of the ellipse.

10. The interlock system of claim 9 wherein the controller is configured to determine the presence state of the magnet-sensor array by measuring the electrical output of the magnets disposed within the circumference of the circle and to determine the position state of the magnet-sensor array by measuring the electrical output of the magnets disposed on the circumference of the circle.

11. The interlock system of claim 1 further comprising a magnetic key that includes a magnet array comprising at least two magnets arranged in a geometric array such that the magnetic key may be positioned adjacent to the magnet-sensor array so that each of the at least two magnets engage only a single magnet sensor of the magnet-sensor array.

12. The interlock system of claim 11 further comprising a magnetic-sensor-array retention magnet; wherein one magnet of the magnetic key is configured as a key-retention magnet; and wherein the magnetic-sensor-array retention magnet and the key-retention magnet are configured to magnetically engage each other and thereby retain the magnetic key adjacent to the magnet-sensor array.

13. The interlock system of claim 12:

(a) wherein one magnet sensor of the magnet-sensor array is configured to engage the key-retention magnet when the magnetic-sensor-array retention magnet and the key-retention magnet are magnetically engaged to retain the magnetic key adjacent to the magnet-sensor array; and (b) wherein the controller is configured to determine the presence state of the magnet-sensor array by measuring the electrical output of the magnet sensor of the magnet-sensor array that is configured to engage the key-retention magnet when the magnetic-sensor-array retention magnet and the key-retention magnet are magnetically engaged to retain the magnetic key adjacent to the magnet-sensor array.

14. The interlock system of claim 9 further comprising:

(a) a magnetic key that includes a magnet array comprising three position magnets and one sense magnet arranged roughly in the form of a elliptical array in which the three position magnets are disposed on the circumference of a ellipse and the sense magnet is disposed within the circumference of the ellipse; and (b) wherein the circumference of the roughly elliptical magnet array is substantially equal to the circumference of the roughly elliptical magnet-sensor array.

15. The interlock system of claim 1 wherein at least one sensor of the magnet-sensor array is configured to provide an electrical output indicative of the polarity of detected magnet.

16. The interlock system of claim 1 wherein the controller is further configured to:

(a) determine a position state of the magnet-sensor array by measuring, for each of two or more of the at least three magnet sensors, the electrical output of that magnet sensor;

(b) determine one or more previous position states of the magnet-sensor array;

(c) determine, based on the position state of the magnet-sensor array and the one or more previous position states of the magnet-sensor array, a position-state position for the second electrically controllable switch;

(d) determine a position-state electrical signal to provide to the second electrically controllable switch to set the second electrically controllable switch in the position-state position; and (e) provide the position-state electrical signal to the second electrically controllable switch to set the second electrically controllable switch in the position-state position.

17. The interlock system of claim 16 wherein the controller is further configured to:

(a) determine a position state of the magnet-sensor array by measuring, for each of two or more of the at least three magnet sensors, the electrical output of that magnet sensor; and (b) determine, based on the presence state of the magnet-sensor array and the position state of the magnet-sensor array, the presence-state position for the first electrically controllable switch.

18. The interlock system of claim 16 wherein to determine, based on the position state of the magnet-sensor array and the one or more previous position states of the magnet-sensor array, a position-state position for the second electrically controllable switch the controller is configured to determine whether the position state is the same as the ten previous position states.

19. The interlock system of claim 16 wherein to determine, based on the position state of the magnet-sensor array and the one or more previous position states of the magnet-sensor array, a position-state position for the second electrically controllable switch the controller is configured to determine whether the position state and the one or more previous position states correspond to a predetermined sequence of position states.

* * * * *